US009038412B2

(12) United States Patent
Linder

(10) Patent No.: US 9,038,412 B2
(45) Date of Patent: May 26, 2015

(54) REFREEZABLE ICE BARREL

(75) Inventor: Nathan Linder, West Covina, CA (US)

(73) Assignee: INNOVATIVE DISPLAYWORKS, INC., San Dimas, CA (US)

( * ) Notice: Subject to any disclaimer, the term of this patent is extended or adjusted under 35 U.S.C. 154(b) by 0 days.

(21) Appl. No.: 12/940,946

(22) Filed: Nov. 5, 2010

(65) Prior Publication Data

US 2011/0041546 A1 Feb. 24, 2011

Related U.S. Application Data

(63) Continuation-in-part of application No. 12/490,243, filed on Jun. 23, 2009.

(51) Int. Cl.

| | |
|---|---|
| ***F25D 3/08*** | (2006.01) |
| ***F25D 3/06*** | (2006.01) |
| ***F25D 11/00*** | (2006.01) |
| ***F25D 31/00*** | (2006.01) |
| *F25D 23/06* | (2006.01) |

(52) U.S. Cl.

CPC ..... *F25D 3/06* (2013.01); *F25D 11/006* (2013.01); *F25D 23/061* (2013.01); *F25D 31/007* (2013.01); *F25D 2303/081* (2013.01); *F25D 2303/0831* (2013.01); *F25D 2303/0832* (2013.01)

(58) Field of Classification Search

CPC ..... F25D 3/005; F25D 3/06; F25D 3/08; F25D 11/006; F25D 31/007; F25D 2303/081; F25D 23/061; F25D 2303/0832; F25D 2303/0831; F25D 3/02

USPC ..... 62/344, 346, 354, 457.2, 459.5, 459.9, 62/530, 139, 255, 457.4, 371, 464

See application file for complete search history.

(56) References Cited

U.S. PATENT DOCUMENTS

| | | | | | |
|---|---|---|---|---|---|
| 1,912,577 | A | * | 6/1933 | Glass | 62/433 |
| 2,229,438 | A | * | 1/1941 | Birdsall | 62/46.1 |
| 2,287,681 | A | * | 6/1942 | Hazard | 62/336 |
| 2,572,508 | A | * | 10/1951 | Muffly | 62/180 |
| 2,685,778 | A | * | 8/1954 | Conrad | 62/335 |
| 3,491,548 | A | * | 1/1970 | Christiansen | 62/255 |

(Continued)

FOREIGN PATENT DOCUMENTS

| | | | | | |
|---|---|---|---|---|---|
| GB | 2285306 | A | * | 7/1995 | F25D 3/00 |

OTHER PUBLICATIONS

Response to Office Action dated Mar. 3, 2011 in relation to U.S. Appl. No. 12/490,243.

*Primary Examiner* — Frantz Jules
*Assistant Examiner* — Emmanuel Duke
(74) *Attorney, Agent, or Firm* — Stetina Brunda Garred & Brucker

(57) ABSTRACT

Provided is an environmentally friendly refreezable barrel for chilling a plurality of items in an energy efficient manner that also conserves water. The refreezable barrel includes a cooler body defining an open end and a closed end portion. The cooler body defines a cavity extending from the open end towards the closed end portion. The cavity is configured to receive the plurality of items. A cooling element is disposed within the cooler body and is refreezable to mitigate temperature rise within the cooler body to prolong the melting of ice within the barrel, thereby reducing the overall amount of water used by the barrel. The refreezable barrel also includes a cooler stand defining a recess configured to engage with the closed end portion of the cooler body.

20 Claims, 8 Drawing Sheets

(56) References Cited

U.S. PATENT DOCUMENTS

| | | | | | |
|---|---|---|---|---|---|
| 4,546,900 | A | * | 10/1985 | Lackey | 220/592.16 |
| 4,638,645 | A | * | 1/1987 | Simila | 62/457.1 |
| 4,724,682 | A | * | 2/1988 | Flum et al. | 62/462 |
| 5,048,171 | A | * | 9/1991 | Bidwell et al. | 29/401.1 |
| 5,048,305 | A | * | 9/1991 | Taub | 62/372 |
| 5,201,194 | A | * | 4/1993 | Flynn et al. | 62/457.3 |
| 5,388,429 | A | * | 2/1995 | Shackelford et al. | 62/446 |
| 6,185,942 | B1 | * | 2/2001 | Werrbach et al. | 62/62 |
| 6,269,653 | B1 | * | 8/2001 | Katusa | 62/457.9 |
| RE37,696 | E | * | 5/2002 | Parker | 62/3.63 |
| 6,453,682 | B1 | * | 9/2002 | Jennings et al. | 62/56 |
| 6,925,834 | B2 | * | 8/2005 | Fuchs | 62/457.2 |
| 7,444,825 | B2 | * | 11/2008 | Miller et al. | 62/255 |
| 2003/0010054 | A1 | * | 1/2003 | Esch et al. | 62/354 |
| 2006/0168985 | A1 | | 8/2006 | Gano | |

* cited by examiner

REFREEZABLE ICE BARREL

CROSS-REFERENCE TO RELATED APPLICATIONS

This application is a continuation-in-part application of prior application Ser. No. 12/490,243, filed Jun. 23, 2009, and entitled, Refreezeable Ice Barrel, the disclosure of which is expressly incorporated herein by reference.

STATEMENT RE: FEDERALLY SPONSORED RESEARCH/DEVELOPMENT

Not Applicable

BACKGROUND

The present invention relates generally to ice barrels adapted for holding ice and beverages and, more particularly, to ice barrels configured to reduce the amount of ice required to chill the beverages over an extended period of time.

Ice barrel containers or "beverage containers" are well-known in the art and are commonly utilized at retail markets, sporting events, and promotional events. The ice barrels are typically used to chill beverages at a location which typically does not offer refrigerated cooling. For instance, the ice barrels are frequently located close to check-out counters to entice purchases by departing customers.

The ice barrels generally include a receptacle having an open top, a bottom wall, and a continuous upright sidewall extending between the open top and the bottom wall to from an interior cavity. The interior cavity is generally sized to hold a plurality of beverages, i.e., soft drinks or beer in cans or bottles. It is generally desirable for the beverages to be served at a chilled temperature. Therefore, ice may also be placed within the cavity to chill the beverages.

Over time, the ice within the ice barrel melts, leaving a large volume of water. In order to keep the beverages chilled, the water is generally removed from the ice barrel and the barrel is refilled with fresh ice. However, the ice barrel may be positioned in a location which may not accommodate removal of the water from the barrel. For instance, if the ice barrel is placed at a checkout counter in a convenience store, the ice barrel is generally moved to an outdoor location or a location having a drain in order to remove the water from the interior cavity. Once the water is removed, the ice barrel may be refilled with ice to keep the beverages at a chilled temperature.

Although conventional ice barrels may allow the beverages to be maintained in a chilled temperature, the conventional ice barrels may be inefficient. For instance, the ice barrel may be filled with ice on numerous occasions in order to maintain the beverages at a chilled temperature. As such, the process of removing the water and refilling the ice barrels with ice may consume large amounts of water. In view of the importance of water conservation, it is typically desirable to limit the amount of ice used in the ice barrels. Furthermore, as was mentioned above, the process of draining the water from the interior cavity and refilling the ice barrel with ice may require movement of the ice barrel. Given the amount of water and beverages which may be located within the barrel, movement of the ice barrel may be a strenuous endeavor.

As is apparent from the foregoing, there exists a need in the art for an ice barrel configured to reduce the amount of ice required to chill beverages over an extended period of time.

The present invention address this particular need, as will be discussed in more detail below.

BRIEF SUMMARY

Provided is a refreezable barrel configured to reduce the amount of ice used to chill beverages over an extended period of time. In this manner, the refreezable barrel may require fewer ice refills and thus conserve water to provide a more environmentally friendly alternative to conventional ice barrels.

The refreezable barrel includes a cooler body defining an open end and a closed end portion. The cooler body defines a cavity extending into the cooler body from the open end towards the closed end portion. The cavity is configured to receive a plurality of items, such as ice and beverages. A cooling element is disposed within the cooler body and is refreezable to mitigate temperature rise within the cooler body. The refreezable barrel also includes a cooler stand defining a recess configured to engage with the closed end portion of the cooler body.

The refreezable barrel may advantageously be chilled to freeze/chill the refreezable elements before ice is placed within the cooler body. By freezing/chilling the cooler body, the temperature difference between the cooler body and the ice may be reduced. Consequently, the ice may last for a longer period of time before it melts, which may reduce the overall amount of ice used to chill the beverages. To facilitate that end, the refreezable ice barrel may have integrated therein an ice maker or refrigerator unit to produce ice or otherwise maintain refrigerated temperatures.

According to another embodiment, there is provided a refreezable barrel for use with a refreezable substance for chilling a plurality of items. The refreezable barrel includes a barrel shell having a shell outer wall and a shell inner wall defining a shell cavity. A barrel insert is disposable within the shell cavity to assume a nested position. The barrel insert includes a closed end portion and an open end portion, as well as an insert inner wall defining an insert cavity. The barrel insert is configured to receive the plurality of items. A cooling element is disposed between the insert inner wall and shell inner wall and in thermodynamic communication with the barrel insert, and is operative to freeze the refreezable substance.

The present invention is best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
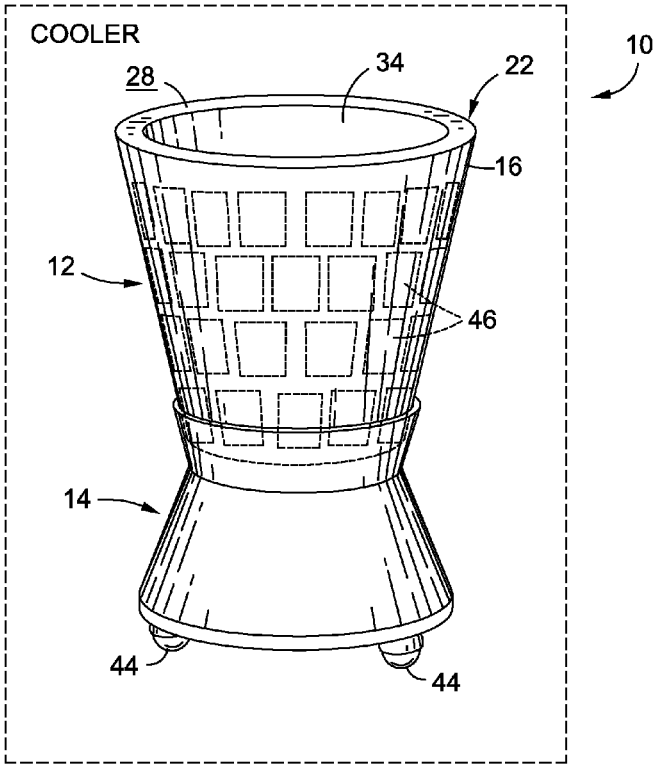
FIG. 1 is an upper perspective view of a refreezable barrel including a refreezable cooler body and a cooler stand.

Referring now to the drawings, wherein the showings are for purposes of illustrating a preferred embodiment of the present invention only, and not for purposes of limiting the same, FIG. 1 illustrates one embodiment of a refreezable barrel 10. The refreezable barrel 10 includes a cooler body 12 and a cooler stand 14. The cooler body 12 is disposable on the cooler stand 14 to facilitate movement of the cooler body 12. Ice may be disposed within the cooler body 12 to chill food items and/or beverages. The cooler body 12 is refreezable to prolong the melting of ice disposed within the cooler body 12. In this manner, the cooler body 12 may reduce the amount of ice needed to keep food and/or beverages at a chilled temperature. As such, the refreezable barrel 10 may provide an environmentally friendly alternative to conventional ice barrels due to its ability to conserve water by reducing ice consumption.

Figure 2:
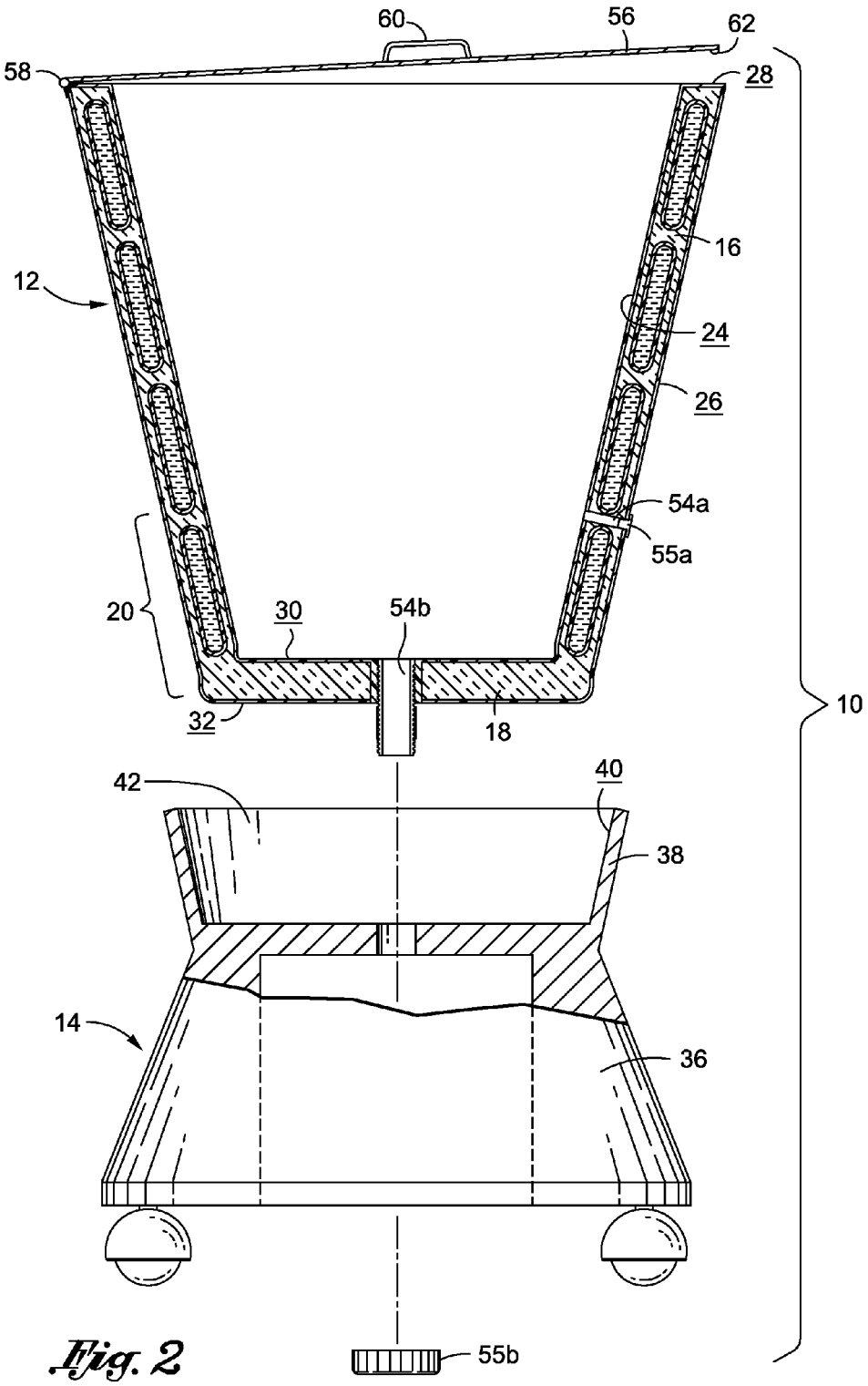
FIG. 2 is a side sectional view of a refreezable barrel having a lid, an upper drain and a lower drain.

Referring now to FIG. 2, the cooler body 12 includes a cooler sidewall 16 and a cooler base 18. The cooler body 12 defines a closed end portion 20 adjacent the cooler base 18 and an open end 22 opposite the cooler base 18. In the embodiment depicted in FIG. 2, the cooler sidewall 16 defines a diameter that increases from the cooler base 18 toward the open end 22. However, it is understood that the cooler sidewall 16 may define a non-circular shape without departing from the spirit and scope of the present invention. The cooler sidewall 16 includes a sidewall inner surface 24, a sidewall outer surface 26, and a sidewall upper surface 28 extending between the sidewall inner surface 24 and the sidewall outer surface 26 adjacent the open end 22 of the cooler body 12. The cooler base 18 defines a cooler base inner surface 30 and a cooler base outer surface 32. The cooler base inner surface 30 and sidewall inner surface 24 collectively define a cavity 34 which extends into the cooler body 12 from the open end 22 towards the cooler base 18.

The refreezable barrel 10 may additionally include a cooler stand 14 for supporting the cooler body 12. The cooler stand 14 includes a stand base 36 and a stand sidewall 38 protruding from the stand base 36. The stand sidewall 38 includes a sidewall inner surface 40 defining a stand recess 42. The stand recess 42 is sized and configured to receive the closed end portion 20 of the cooler body 12 to support the cooler body 12. In the embodiment depicted in FIG. 2, the cooler base outer surface 32 and a portion of the cooler sidewall outer surface 26 engage with the stand sidewall inner surface 40 when the cooler body 12 is seated on the cooler stand 14. The cooler stand 14 may additionally include one or move movement elements 44, such as wheels, to facilitate movement of the cooler stand 14. It is also contemplated that the movement elements 44 may be connected directed to the cooler body 12.

The cooler stand 14 depicted in FIG. 2 includes a sidewall inner surface 40 which supports the cooler base outer surface 32. However, it is also contemplated that the cooler stand 14 may include an opening which receives the closed end portion 20 of the cooler body 12 and circumferentially engages with the cooler body 12.

The refreezable barrel 10 further includes one or more refreezable cooling element(s) 46 disposed within the cooler body 12. The cooling element 46 is freezable/chillable to chill the cooler body 12 to prolong the melting of ice disposed within the cooler body 12. In other words, the temperature difference between the temperature of the cooler body 12 and the melting temperature of the ice may be reduced to prolong the lifespan of the ice. In this regard, the cooler body 12 may be disposed in a remote, non-refrigerated location (i.e., adjacent a counter at a convenience store or in a stadium) at a chilled temperature. Therefore, when ice and beverages are disposed within the cavity 34, the initial chilled temperature of the cooler body 12 prolongs melting of the ice. Instead of the ice and beverages being disposed within an ice barrel at an elevated temperature (i.e., at a temperature well above the freezing point of ice), the cooler body 12 is freezable to a temperature at or near the freezing point of the ice to extend the melting period of the ice. As used herein, the melting period is defined as the time period beginning when a quantity of ice is disposed within the refreezable barrel 10 and ending when the all of the quantity of ice has melted.

In the particular embodiment illustrated in FIGS. 1 and 2, the cooler body 12 includes a plurality of cooling elements 46 disposed within the cooler sidewall 16. Cooling elements 46 may additionally be disposed within the cooler base 18. The cooling elements 46 are disposed in spaced relation relative to each other. The cooling elements 46 may include refrigerants commonly used in the art, such as liquid or gel refrigerants. The refrigerant may be repeatedly chilled or frozen to extend the melting period of the ice disposed within the cavity 34. The refrigerant may be disposed within an outer shell to separate the refrigerant from the cooler body 12.

Figure 3:
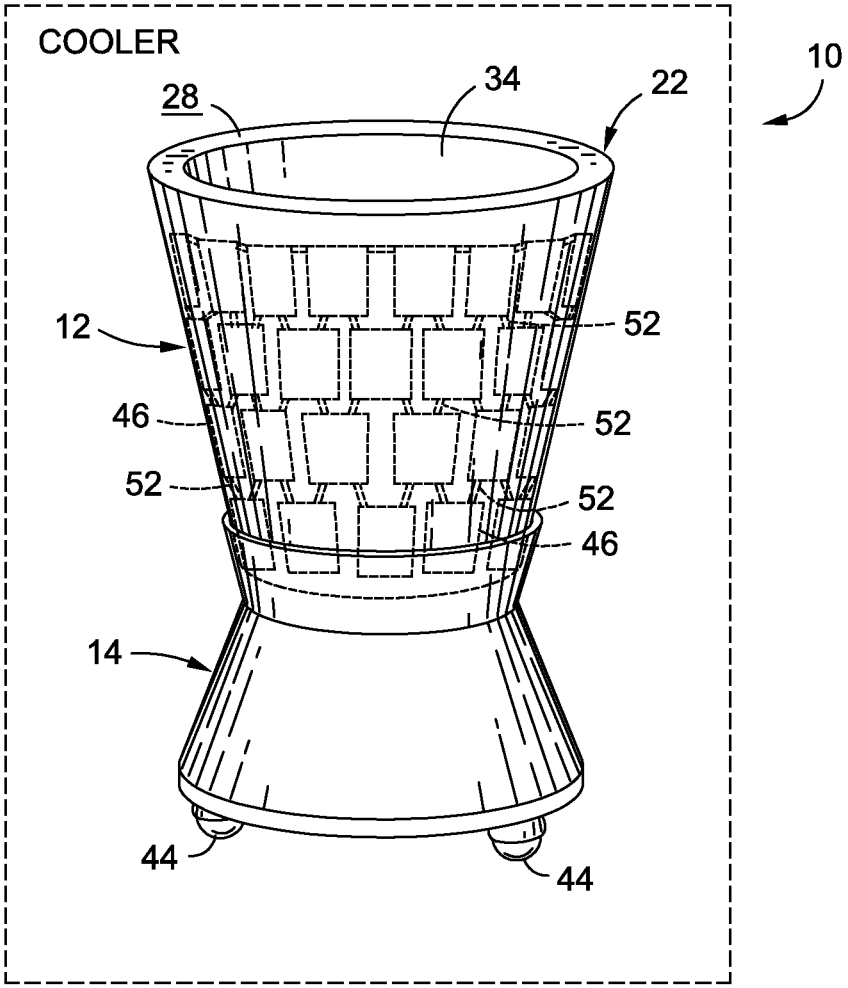
FIG. 3 is a side sectional view of a refreezable barrel having a plurality of fluidly interconnected cooling elements.

The cooling elements 46 may be integrally formed within the cooler body 12. In this manner, the cooling elements 46 may be molded within the cooler body 12 during formation of the cooler body 12 to enclose the refrigerant within the cooler body 12. According to another embodiment, and referring now specifically to the embodiment illustrated in FIGS. 3 and 4, the refrigerant may be added to the cooler body 12 after the formation of the cooler body 12. For instance, the cooler body 12 may be manufactured with one or more pockets 48 formed therein. The pocket(s) 48 may be sized and configured to receive the refrigerant after manufacture of the cooler body 12. In this manner, the pocket(s) 48 may include an access channel 50 extending through the cooler sidewall 16 to allow a liquid or gel refrigerant to be disposed into the pocket(s) 48. In the embodiment depicted in FIG. 3, the cooler body 12 includes a plurality of pockets 48 which are fluidly connected via fluid passageways 52 to disperse the refrigerant through the cooler body 12.

The refrigerant disposed within the cooler body 12 may include liquids or gels commonly used in the art. It is also contemplated that water/ice may be used to cool the cooler body 12. Referring now to the embodiment depicted in FIG. 4, the cooler body 12 includes a single cooling element 46 disposed within the cooler sidewall 16. The cooler sidewall 16 includes a single pocket 48 which circumnavigates the cooler cavity 34. Given the large area of the cooling element 46 in the embodiment illustrated in FIG. 4, relative to the cooling elements 46 depicted in FIGS. 1-3, it may be desirable to use water as the refrigerant. In this manner, water may be disposed within the pocket 48 formed within the cooler body 12. Subsequently, the cooler body 12 may be disposed within a freezer to chill or freeze the water. It is understood that water expands when it is frozen; therefore, the pocket 48 may not be completely filled with water to accommodate the expansion upon freezing. The expansion may also be accommodated by forming the cooler body 12 from a flexible material capable of withstanding the expansion.

Although the cooler body 12 may be configured to prolong the melting of ice disposed within the cavity 34, at some point, the ice will likely melt leaving water in the cavity 34. The cooler body 12 may include one or more drains 54 formed therein to facilitate removal of the water from the cavity 34. The drains 54 extend from the sidewall inner surface 24 to the sidewall outer surface 26. The drains 54 may also extend from the base inner surface 30 to the sidewall outer surface 26 or base outer surface 32. The drains 54 may include plugs 55 to restrict fluid flow through the drains 54. As shown in FIG. 2, the cooler body 12 includes two drains 54, namely an upper drain 54*a* and a lower drain 54*b* having respective plugs 55*a* and 55*b*. The upper drain 54*a* may be used initially to drain a portion of the cavity 34. Partial draining of the cavity 34 may be desirable to facilitate movement of the cooler body 12. However, the entire cavity 34 may be drained via the lower drain 54*b*.

Various implementations of the refreezable barrel 10 may include a lid 56 disposable over the open end 22 of the cooler body 12. The lid 56 may temporarily cover the open end 22 of the cooler body 12 to prevent foreign objects or debris from entering the cavity 34. The lid 56 may be connected to the cooler body 12 via a hinge 58 to enable pivotal movement of the lid 56 relative to the cooler body 12 between an open position and a closed position. In the closed position, the cavity 34 is substantially covered by the lid 56. As the lid 56 moves from the closed position toward the open position, the cavity 34 becomes uncovered.

Figure 4:
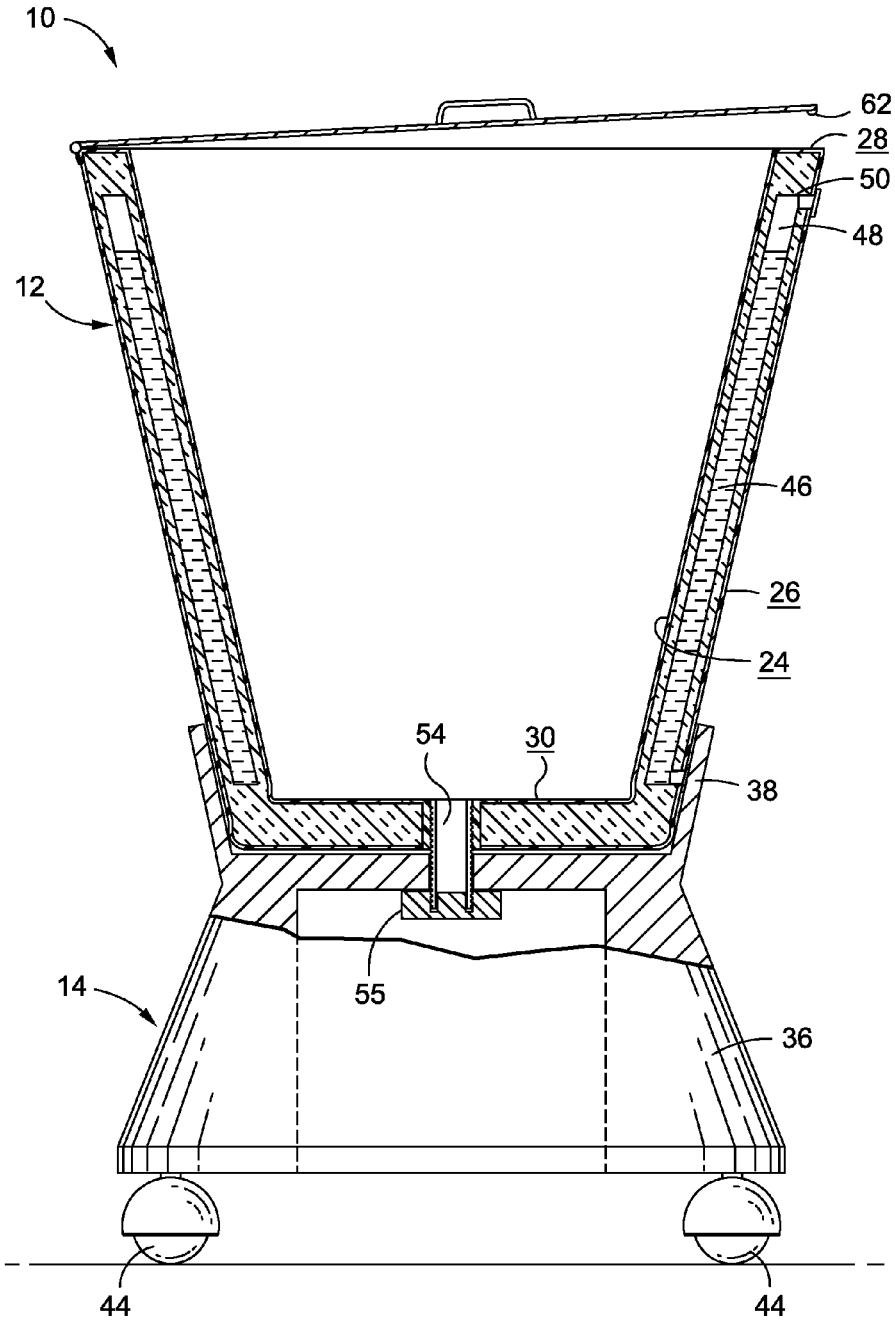
FIG. 4 is a side sectional view of a refreezable barrel having a single cooling element.

The lid 56 may include a handle 60 to facilitate movement of the lid 56 between the open and closed positions. The lid 56 may further include a seal 62 which engages with the cooler body 12 when the lid 56 is in the closed position to create a substantially air-tight seal between the lid 56 and the cooler body 12 when the lid 56 is in the closed position. Although FIGS. 2 and 4 depicts the seal 62 on the lid 56, it is understood that the seal 62 may be disposed on the cooler body 12 for engagement with the lid 56 when the lid 56 is placed in the closed position.

Figure 5:
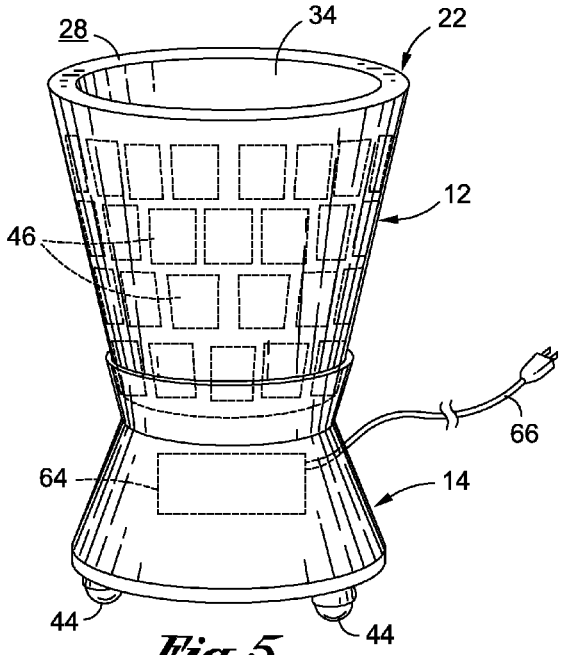
FIG. 5 is an upper perspective view of a refreezable barrel having an ice maker disposed within a cooler stand.

As stated above, the refreezable barrel 10 may be filled with ice to chill beverages for an extended period of time. To this end, one embodiment of the refreezable barrel 10 includes an ice maker or refrigeration unit 64 disposed therein. As depicted in FIG. 5, the ice maker or refrigeration unit 64 is disposed within the cooler stand 14. By disposing the ice maker or refrigeration unit 64 within the cooler stand 14, the cooler body 12 may be easily filled with ice. The ice maker or refrigeration unit 64 may be battery powered, or receive power from an electrical outlet via a power chord 66.

The ice maker or refrigeration unit 64 may be connected to a water input, or the cooler stand 14 may include a water reservoir disposed therein. As ice is produced by the ice maker 64, the ice may fall into an ice storage chamber within the cooler stand 14. The cooler stand 14 may further include an access door which may be opened or closed to provide access to the ice storage chamber.

Figure 6:
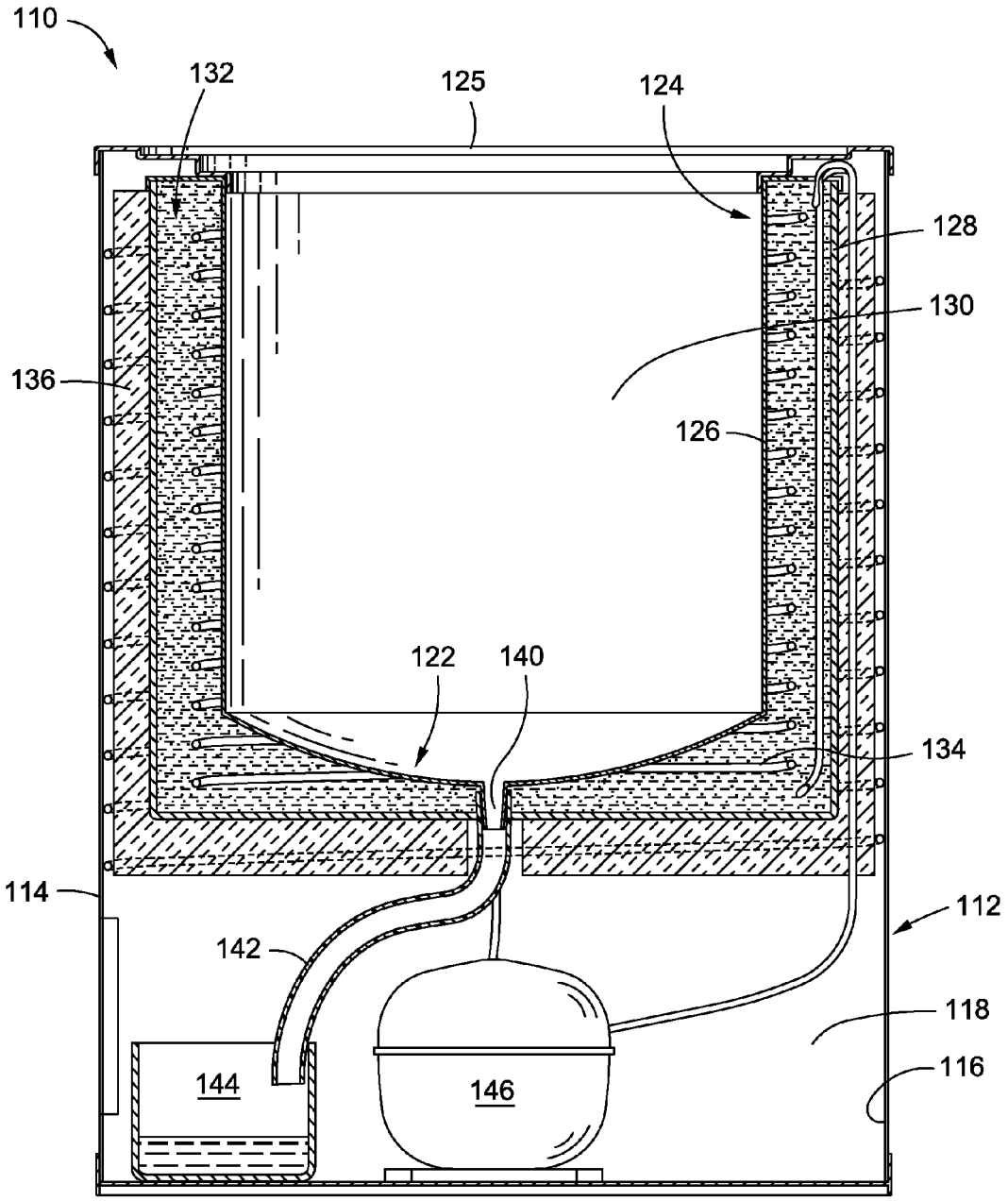
FIG. 6 is a side sectional view of another embodiment of a refreezable barrel.
Figure 7:
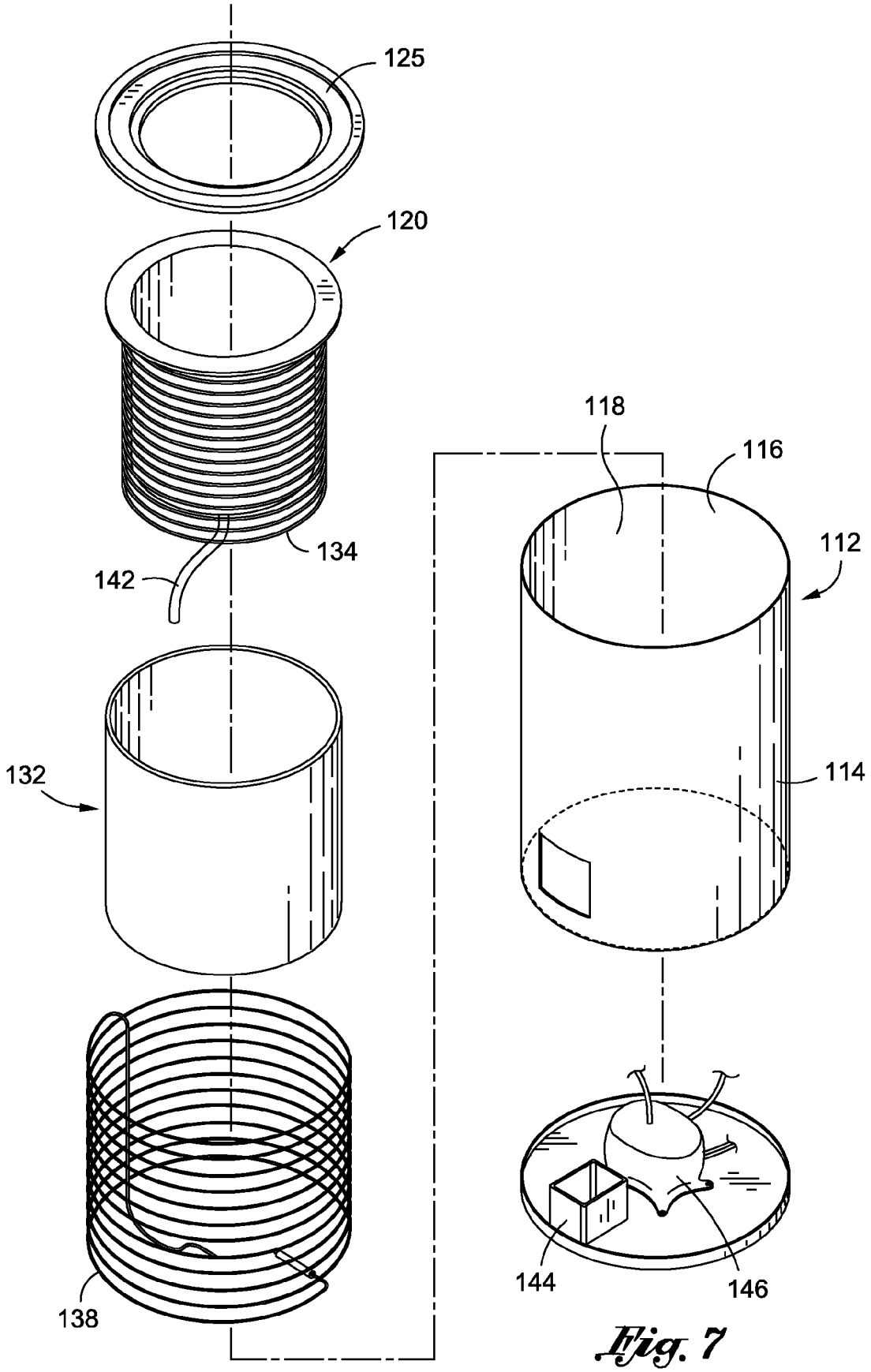
FIG. 7 is an exploded upper perspective view of the embodiment depicted in FIG. 6.
Figure 8:
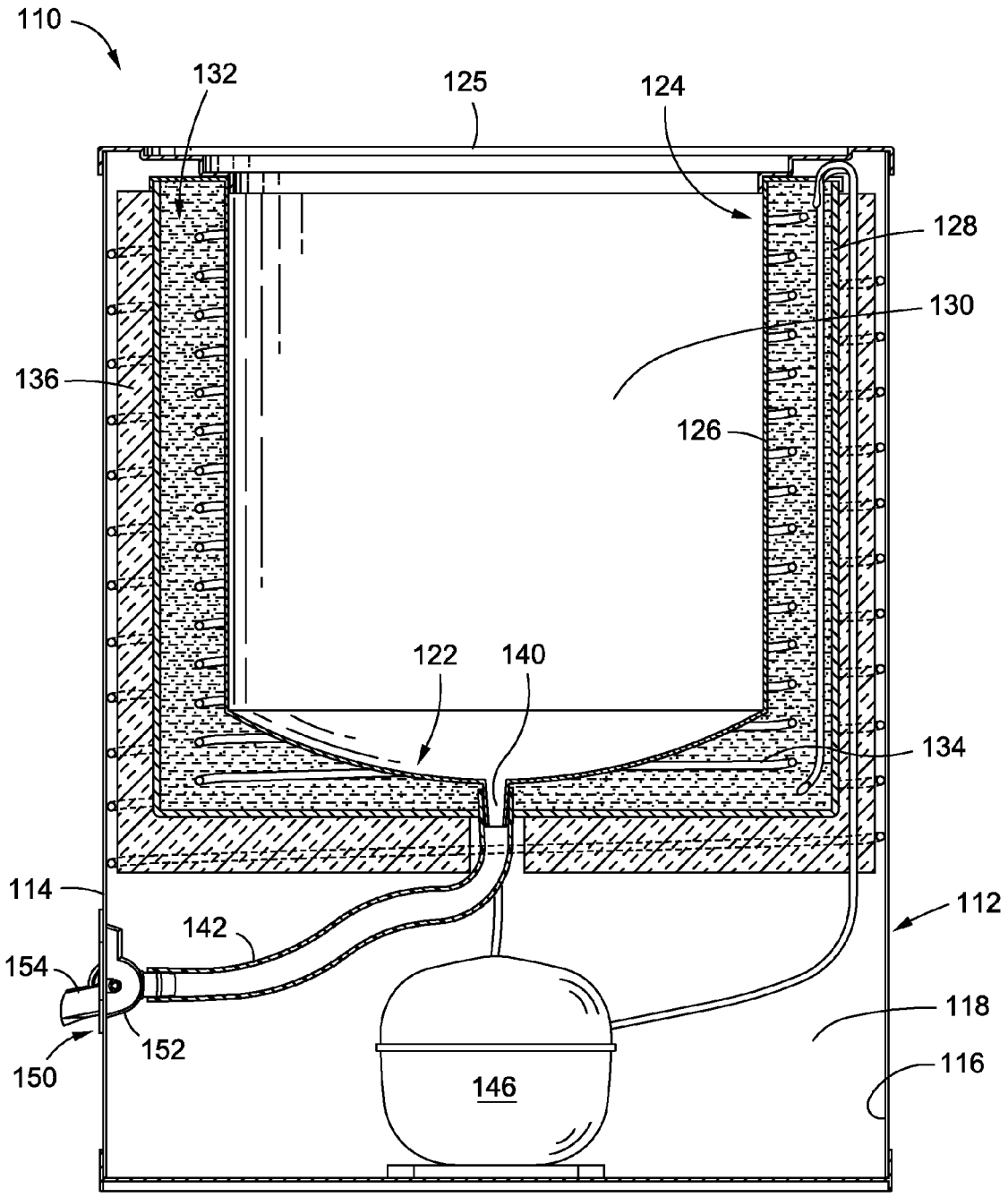

Referring now to FIGS. 6 and 7, there is depicted another embodiment of an environmentally friendly refreezable barrel 110 for chilling beverages, food items, and the like. The refreezable barrel 110 may be chilled during a "freezing cycle" and set up in a vending location during a "vending cycle." More specifically, the refreezable barrel 110 includes an electrical cooling system for chilling/freezing cooling gel or similar media sealed inside the refreezable barrel 110. The cooling gel is refrigerated during the "freezing cycle" to lower the temperature of the cooling gel. Once the cooling gel is chilled, the refreezable barrel 110 may be unplugged, and filled with products (i.e., bottled beverages or other items), and positioned in a desired location suitable for vending the products. The refreezable barrel 110 utilizes the chilled/frozen gel to maintain the items disposed therein at a chilled temperature. This period is referred to as the "vending cycle." During the "vending cycle," the refreezable barrel 110 does not need the electrical cooling system to be running. Accordingly, the refreezable barrel 110 may be disposed remote from an electrical source during the "vending cycle." At the end of the "vending cycle", refreezable barrel 110 will be plugged back into an electrical source to begin the "freezing cycle" again. These cycles may follow each other and repeat continuously.

One embodiment of the refreezable barrel 110 includes a barrel shell 112 having a shell outer wall 114 and a shell inner wall 116 defining a shell cavity 118. A barrel insert 120 is disposable within the shell cavity 118, and includes a closed end portion 122 and an opposing open end portion 124. The barrel insert 120 includes an insert inner wall 126 and insert outer wall 128 defining an insert cavity 130. The barrel insert 120 is disposable within the shell cavity 118 to assume a nested position within the barrel shell 112. The insert cavity 130 is sized to receive the beverages, or other food items that are to be chilled. A cover 125 may be disposed over and between the barrel shell 112 and the barrel insert 120 to cover any gap therebetween. A cooling element 132, such as a refreezable gel, is disposable between the insert inner wall 126 and the insert outer wall 128 to place the refreezable gel in thermodynamic communication with the barrel insert 120. As used herein, the phrase "thermodynamic communication" refers to the ability of the cooling element 132 to change the temperature of the barrel insert 120. Therefore, the cooling element 132 is disposable in a position to influence the temperature of the barrel insert 112. This may be done by conduction, convection or radiation. In this regard, the refreezable gel may be chilled to keep items disposed within the barrel insert 120 at a chilled temperature.

According to one implementation, the cooling element 132 may include evaporator lines 134 for improved heat transfer. The evaporator lines 134 may be coated or have a protective barrier disposed thereon to mitigate undesirable chemical reactions between the cooling gel and the evaporator lines 134.

It is additionally contemplated that insulation 136 (See FIG. 6) may be disposed about the barrel insert 120. As depicted in FIG. 6, the insulation 136 is disposed between the insert outer wall 128 and the shell inner wall 116. The insulation 136 may isolate the cooling gel 132 from a hot condensing coil 138.

During use of the refreezable barrel 110, it is contemplated that ice may be disposed within the insert cavity 130 to further chill items disposed therein. The chilled refreezable gel slows the melting of the ice, thereby reducing the overall amount of ice used to chill the products, and making the refreezable barrel 110 an environmentally friendly device that conserves water by reducing ice usage. However, once the ice melts, water may undesirably accumulate within the insert cavity 130. Therefore, one embodiment of the refreezable barrel 110 includes a drain 140 formed within the barrel insert 120 to remove the water from the insert cavity 130. A hose 142 may be connected to the drain 140 to direct fluid to a drip tray 144, as shown in FIG. 6.

Figure 9:
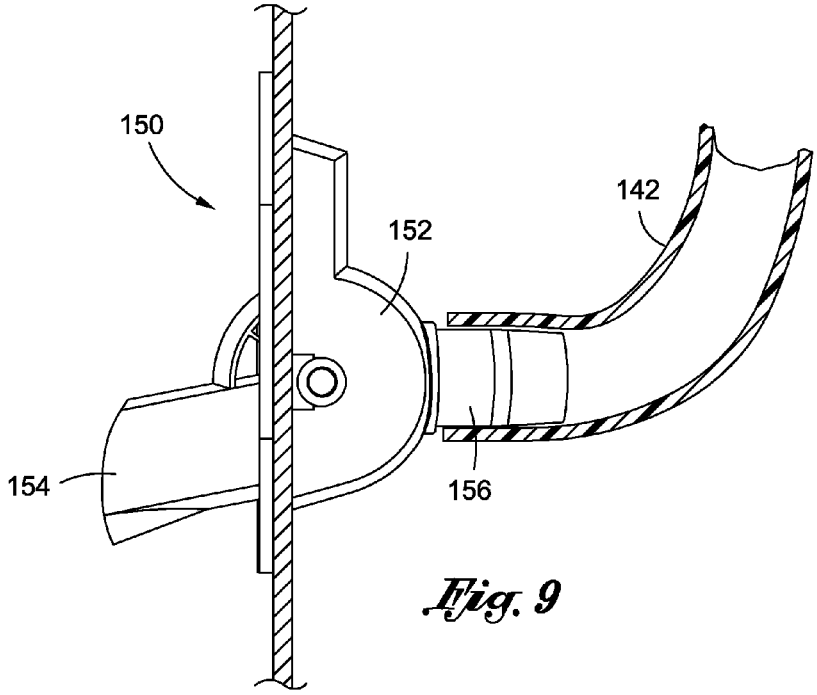
Figure 10:
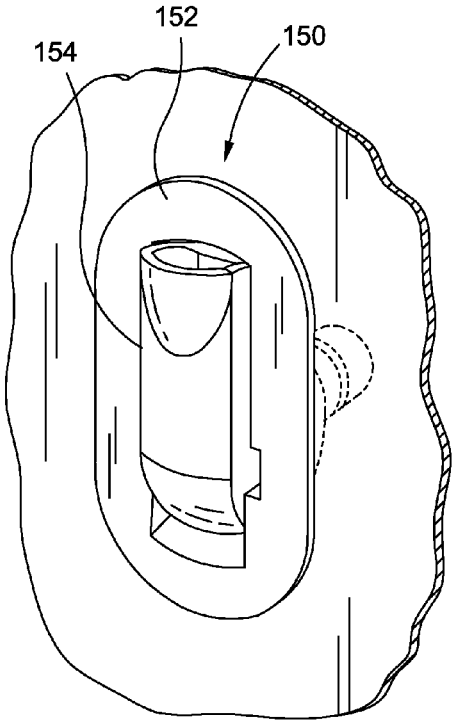
Figure 11:
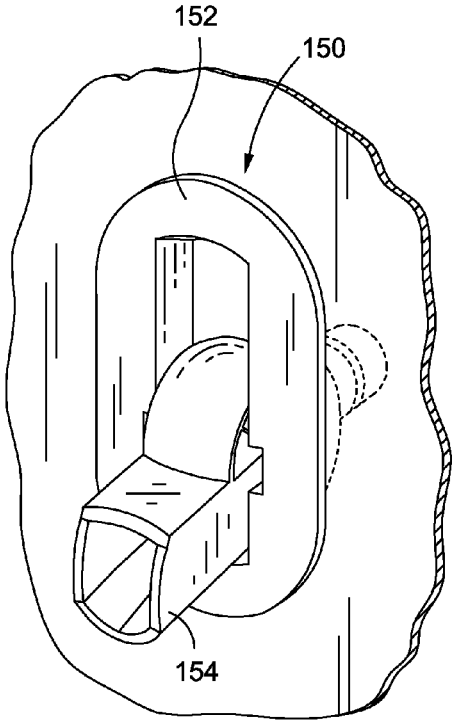

It is also contemplated that the hose 142 may be connected to a drain valve 150 located on an external portion of the barrel 110, as depicted in FIGS. 8-11. FIG. 9 is an enlarged sectional view showing the connection between the drain valve 150 and the hose 142. The drain valve 150 includes a valve base 152 connected to the barrel 110 and a valve arm 154 pivotally coupled to the valve base 152. The valve arm 154 is pivotable between a closed position (FIG. 10), wherein the drain valve 150 substantially restricts fluid flow from the barrel 110, and an open position (FIG. 11), wherein the drain valve 150 allows fluid to drain from the barrel 110. The valve base 152 includes a cylindrical connector 156 that is engageable with the hose 142 to establish fluid communication from the hose 142 and the valve base 152. The cylindrical connector 156 defines an opening that extends through the valve base 152. The valve arm 154 also includes an opening that is aligned with the valve base opening when the valve arm 154 is in the open position to allow fluid to drain out of the barrel 110. When the valve arm 154 is in the closed position, the opening in the valve arm 154 is moved out of alignment with the opening in the valve base 152 to restrict fluid flow through the valve arm 154.

It is additionally contemplated that various embodiments of the refreezable barrel 110 may be configured for use without ice. Certain implementations of the refreezable barrel 110 have been able to maintain an ambient product temperature of approximately 38° F. for more than twelve hours after an initial twelve hour "freezing cycle." The feature of the refreezable barrel 110 that allows the barrel 110 to accommodate ice, or keep products chilled without ice makes the barrel 110 a hybrid between a traditional ice barrel and a traditional refrigerated barrel cooler.

The electric cooling unit 146 may be disposed at the base of the barrel shell 112. The electric cooling unit 146 may include R-134A, $CO_2$, or alternative refrigerant to cool the cooling gel. The electric cooling unit 146 may employ a thermoelectric compressor, or a variable speed energy efficient compressor. The electric cooling unit 146 may include a power cord for receiving power from an external power source. The power cord may be retractable in nature to reduce the likelihood that the cord catches, or snaps when the barrel 110 is moved.

It is contemplated that the refreezable barrel 110 may define a wide range of shapes and sizes. In the embodiment depicted in FIGS. 6 and 7, the refreezable barrel 110 defines a substantially cylindrical shape. Along these lines, the barrel shell 112, barrel insert 120, and insulation 136 all define substantially cylindrical shapes. However, one skilled in the art would appreciate that the barrel shell 112, insulation 136, and barrel insert 120 may define other shapes, such as square, rectangular, triangular, and oval shapes, without departing from the spirit and scope of the present invention.

The refreezable barrel 110 may include advertising or decorative indicia located on external surfaces thereof. The indicia may be used as advertising for products located within the barrel 110. The indicia may also create an aesthetic appearance to attract customers to the barrel 110.

Various embodiments of the refreezable barrel 110 may include wheels for facilitating movement of the barrel 110. In one implementation, small caster-type wheels may be placed on the bottom of the barrel 110 to allow the barrel 110 to be moved by an individual. In another implementation, larger, bicycle-type wheels may be connected to the barrel 110, along with a push-pedal to enable movement of the barrel 110 over larger distances.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A refreezable barrel for use with ice and a power source, the refreezable barrel being operative to chill a plurality of items, the refreezable barrel comprising:

a barrel shell having a shell outer wall and a shell inner wall defining a shell cavity;

a barrel insert having a closed end portion and an open end portion, the barrel insert includes an insert inner wall defining an insert cavity, the barrel insert being configured to receive the plurality of items and the ice, the barrel insert being disposable within the shell cavity to assume a nested position;

an insulation element disposed within the barrel shell and positioned between the shell inner wall and the barrel insert to define an enclosed cooling zone between the insulation element and the barrel insert, and a heat removal zone between the insulation element and the shell inner wall;

a refreezable substance disposed within the cooling zone; and a cooling coil disposed within the cooling zone and encapsulated within the refreezable substance, the cooling coil extending around the barrel insert and along the barrel insert substantially along a length thereof from the closed end portion toward the open end portion, the cooling coil being configured to chill the cooling zone to freeze the refreezable substance for mitigating ice melting within the barrel insert to conserve water; and a heating coil disposed within the heat removal zone;

the refreezable barrel being configured to undergo a cooling cycle wherein the cooling coil is disposed in operative communication with the power source to chill the refreezable substance to a prescribed temperature;

the refreezable barrel being configured to undergo a vending cycle subsequent to the cooling cycle, wherein the refreezable barrel is physically disconnected from the power source and the refreezable barrel is configured to maintain a temperature within the insert cavity of less than 40 degrees Fahrenheit for at least 6 hours when the insert cavity is at least partially filled with ice at the beginning of the vending cycle.

2. The refreezable barrel recited in claim 1, wherein the shell outer wall defines a substantially cylindrical shape.

3. The refreezable barrel recited in claim 1, wherein the insert outer wall defines a substantially cylindrical shape.

4. The refreezable barrel recited in claim 1, wherein the cooling coil substantially circumnavigates the barrel insert.

5. The refreezable barrel recited in claim 1, wherein the shell cavity and insert cavity are coaxially aligned when the barrel insert is in the nested position.

6. The refreezable barrel recited in claim 1, further comprising a wheel connected to the barrel shell for facilitating movement of the refreezable barrel.

7. The refreezable barrel recited in claim 1, wherein the barrel insert includes a flange disposed about the insert inner wall.

8. The refreezable barrel recited in claim 1, further including a lid moveable between a closed position and an open position relative to the insert cavity, the lid substantially covering the insert cavity when disposed in the closed position.

9. The refreezable barrel recited in claim 1, wherein the barrel insert includes a drainage bore disposed adjacent the closed end portion, the drainage bore extending from the insert inner wall to the insert outer wall.

10. The refreezable barrel recited in claim 9, further comprising a drainage tray in fluid communication with the drainage bore to receive fluid from the drainage bore.

11. The refreezable barrel recited in claim 10, further comprising a hose fluidly connecting the drainage bore and the drainage tray.

12. The refreezable barrel recited in claim 1, wherein the heating coil circumnavigates the barrel insert.

13. The refreezable barrel recited in claim 1, wherein the cooling coil is encapsulated within the refreezable substance.

14. The refreezable barrel recited in claim 13, wherein the cooling coil is encapsulated by the refreezable substance.

15. The refreezable barrel recited in claim 13, wherein the coiling coil is spaced from the barrel insert.

16. The refreezable barrel recited in claim 1, wherein the cooling coil is spaced from the insert inner wall and circumnavigates at least a portion of the cooling zone.

17. The refreezable barrel recited in claim 1, wherein the cooling cycle continues for 12 hours and the vending cycle endures for 12 hours immediately subsequent to the cooling cycle, the refreezable barrel configured to maintain a temperature of approximately 38 degrees Fahrenheit within the insert cavity during the vending cycle.

18. The refreezable barrel recited in claim 1, wherein the refreezable barrel is configured to be moved away from the power source as the refreezable barrel transitions from the cooling cycle to the vending cycle.

19. A refreezable barrel for use with ice and a power source, the refreezable barrel being operative to chill a plurality of items, the refreezable barrel comprising:

a barrel shell having a shell outer wall and a shell inner wall defining a shell cavity;

a barrel insert having a closed end portion and an open end portion, the barrel insert includes an insert inner wall defining an insert cavity, the barrel insert being configured to receive the plurality of items and the ice, the barrel insert being disposable within the shell cavity to assume a nested position;

an insulation element disposed within the barrel shell and positioned between the shell inner wall and the barrel insert to define a cooling zone between the insulation element and the barrel insert, and a heat removal zone between the insulation element and the shell inner wall;

a refreezable substance disposed within the cooling zone; and a cooling coil encapsulated within the refreezable substance and disposed within the cooling zone and configured to chill the cooling zone to freeze the refreezable substance for mitigating ice melting within the barrel insert to conserve water; and a heating coil disposed within the heat removal zone;

the refreezable barrel being configured to undergo a cooling cycle wherein the cooling coil is disposed in operative communication with the power source to chill the refreezable substance to a prescribed temperature;

the refreezable barrel being configured to undergo a vending cycle subsequent to the cooling cycle, wherein the refreezable barrel is physically disconnected from the power source and the refreezable barrel is configured to maintain a temperature within the insert cavity of less than 40 degrees Fahrenheit for at least 6 hours when the insert cavity is at least partially filled with ice at the beginning of the vending cycle.

20. The refreezable barrel recited in claim 19, wherein the cooling coil is in physical contact with the refreezable substance.

* * * * *